United States Patent [19]

Andis

[11] Patent Number: 4,538,362

[45] Date of Patent: Sep. 3, 1985

[54] HAIR DRYER AND CONCENTRATOR WITH RELEASABLE CONNECTING MEANS

[75] Inventor: Matthew L. Andis, Racine, Wis.

[73] Assignee: Andis Company, Racine, Wis.

[21] Appl. No.: 546,839

[22] Filed: Oct. 31, 1983

[51] Int. Cl.[3] ..... A45D 20/12

[52] U.S. Cl. ..... 34/97; 34/101; 219/370

[58] Field of Search ..... 34/97, 101; 285/7; 132/7, 9; 219/367, 368, 369, 370

[56] References Cited

U.S. PATENT DOCUMENTS 3,860,174 1/1975 Cercone ..... 34/97
3,869,751 3/1975 Boyd et al. ..... 285/7

FOREIGN PATENT DOCUMENTS 280325 4/1952 Switzerland ..... 34/97

*Primary Examiner*—Larry I. Schwartz
*Attorney, Agent, or Firm*—Michael, Best & Friedrich

[57] ABSTRACT

A hair drying assembly comprising a hair drying including a housing defining a straight line air pathway therethrough. The housing includes a circular air outlet, and an elongated handle is connected to the housing. The hair drying assembly also includes a hollow concentrator including an elongated outlet and a circular inlet, and a mechanism for releasably connecting the concentrator to the dryer housing so that the concentrator circular inlet is aligned with the hair dryer circular outlet and so that the concentrator elongated outlet is parallel to the handle. The connecting mechanism comprises tabs on one of the hair dryer housing and the concentrator, and tab engaging projections on the other of the hair dryer housing and the concentrator for releasably holding the tabs when the concentrator circular inlet is adjacent the hair dryer circular outlet and the concentrator is rotated in one direction relative to the hair dryer. The tab engaging projections also release the tabs when the concentrator is rotated in an opposite direction relative to the hair dryer.

17 Claims, 8 Drawing Figures

HAIR DRYER AND CONCENTRATOR WITH RELEASABLE CONNECTING MEANS

BACKGROUND OF THE INVENTION

This invention relates to hair drying assemblies and, more particularly, to hair drying assemblies including a hair dryer including a housing defining a straight line air pathway therethrough, concentrator, and means for releasably connecting the concentrator to the hair dryer.

SUMMARY OF THE INVENTION

This invention provides a hair drying assembly comprising a hair dryer including a housing defining a straight line air pathway therethrough. The housing includes a circular air outlet, and an elongated handle is connected to the housing. The hair drying assembly also includes a hollow concentrator including an elongated outlet and a circular inlet, and means for releasably connecting the concentrator to the dryer housing so that the concentrator circular inlet is aligned with the hair dryer circular outlet and so that the concentrator elongated outlet is parallel to the handle. The connecting means comprises projection means on one of the hair dryer housing and the concentrator, and projection engaging means on the other of the hair dryer housing and the concentrator for releasbly holding the projection means when the concentrator circular inlet is adjacent the hair dryer circular outlet and the concentrator is rotated in one direction relative to the hair dryer. The projection engaging means also releases the projection means when the concentrator is rotated in an opposite direction relative to the hair dryer.

One of the principle features of this invention is the provision of a hair drying assembly which can easily serve four different functions interchangeably. One function is a hair dryer with a straight line air pathway therethrough. The second function is a hair dryer with a concentrator for a concentrated air stream. The third function is a hair dryer with a comb attachment permitting hair drying while combing hair. And, the fourth function is a hair dryer with a brush attachment permitting hair drying while brushing hair.

Another of the principle features of the invention is the provision of such a hair drying assembly which is relatively inexpensive to manufacture.

Other features and advantages of embodiments of the invention will become apparent upon reviewing the following drawings, detailed description and the appended claims.

DESCRIPTION OF THE PREFERRED EMBODIMENT

Figure 1:
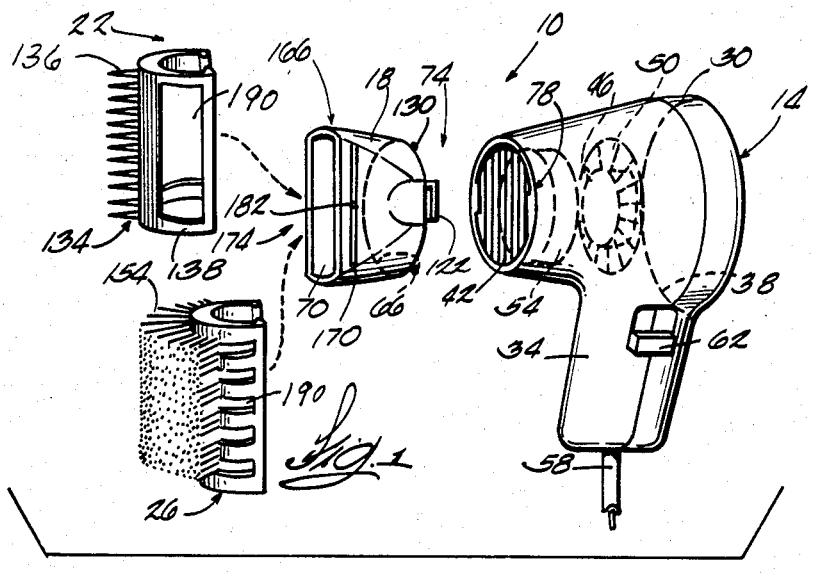
FIG. 1 is an exploded perspective view of a hair dryer, concentrator, brush attachment and comb attachment which embodies various of the features of the invention.

Illustrated in FIG. 1 is a hair drying assembly 10 comprising a hair dryer 14, a concentrator 18, and grooming means in the form of a comb attachment 22 or a brush attachment 26.

The hair dryer 14 comprises a housing 30 and an elongated handle 34 connected to the housing 30. The housing 30 is hollow and defines a straight line air pathway through the housing 30 between a circular air inlet 38 and a circular air outlet 42. Supported in the straight line air pathway by the housing 30 is an electric motor 46, a turbo fan 50 rotatable by the motor 46, and means for heating the air as it passes along the straight line air pathway in the form of electric heating elements 54. Means 58 is also provided for connecting the electric motor 46 and electric heating elements 54 to a source of power supply.

The hair dryer 14 also includes a switch 62 for turning on and off the electric motor 46 and heating elements 54, and for providing for different air speeds through the hair dryer 14.

Figure 2:
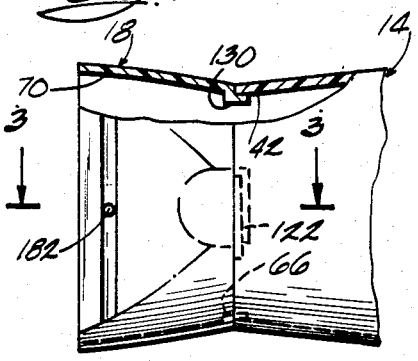
FIG. 2 is a side plain view, partially broken away, of the concentrator connected to the hair dryer shown in FIG. 1.
Figure 3:
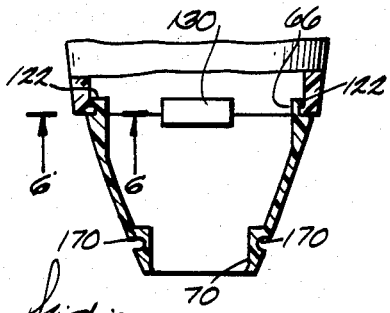
FIG. 3 is a cross-sectional view taken along line 3—3 in FIG. 2.

As illustrated in FIGS. 1 through 6, the concentrator 18 comprises a truncated conical shell which includes a circular inlet 66 (best shown in FIG. 5) and an elongated outlet 70 (best shown in FIG. 1) formed by the partial flattening of the conical shell. As best illustrated in FIG. 3, the concentrator 18 takes air from the hair dryer 14 and delivers the air through the smaller elongated outlet 70 to concentrate the air flow from the hair dryer 14 to reduce the time required for hair drying.

As illustrated in FIGS. 1 through 6, means 74 is also provided for releasbly connecting the concentrator 18 to the hair dryer 14 so that the concentrator circular inlet 66 is aligned with the hair dryer circular outlet 42. The means for releasably connecting the concentrator 18 to the hair dryer 14 also allows the concentrator elongated outlet 70 to be parallel to the handle 34 when the concentrator 18 is secured to the hair dryer housing 30.

More particularly, the connecting means 74 comprises projection means 86 on the hair dryer housing 30 and projection engaging means 106 on the concentrator 18 for releasably holding the projection means 86 when the concentrator circular inlet 66 is adjacent the hair dryer circular outlet 42 and the concentrator 18 is rotated in one direction relative to the hair dryer 14. The projection engaging means 106 also releases the projection means 86 when the concentrator 18 is rotated in the opposite direction relative to the hair dryer 14.

In the particular embodiment shown, the projection means 86 is on the hair dryer housing 30 and the projection engaging means 106 is on the concentrator 18, although these means 86 and 106 may be reversed in other embodiments (not shown).

Figure 4:
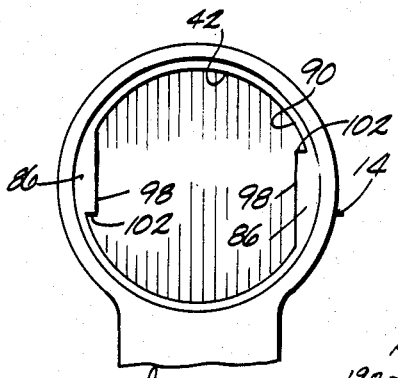
FIG. 4 is a plain view of the front of the hair dryer shown in FIG. 1.

As best illustrated in FIG. 4, the projection means 86 is in the form of a pair of opposed tabs projecting inwardly and perpendicularly to the elongated hande 34 from opposed sides 90 of the housing circular outlet. More particularly, the tabs 86 form generally triangular shaped pieces, including a first side attached to the housing circular outlet 42, a second side 98 which intersects the side 90 of the circular outlet 42, and a third side 102 which is perpendicular to the side 90 of the housing circular outlet 42. In alternate embodiments (not shown), the third side 102 can be eliminated and the second side 98 can further extend over to the side 90 of the circular outlet 42.

Figure 5:
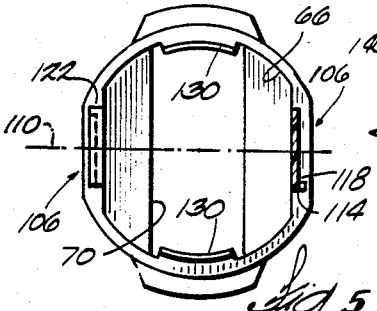
FIG. 5 is a plain view, partially broken away, of the circular inlet of the concentrator shown in FIG. 1.
Figure 6:
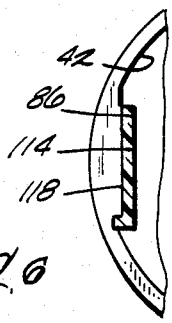
FIG. 6 is a cross-sectional view taken along line 6—6 in FIG. 3.

As best illustrated in FIGS. 2, 5 and 6 the projection engaging means 106 is in the form of opposed projections on the concentrator 18 adjacent the concentrator circular inlet 66. The projections 106 are located on a line 110 perpendicular to the elongated outlet 70 so that the concentrator elongated outlet 70 is parallel to the handle 34 when the concentrator 18 is attached to the dryer 14.

The projections 106 each include an L-shaped portion 114 which, when the concentrator is placed adjacent the hair dryer 14, is received in the housing circular outlet 42 along the sides 90 thereof. The L-shaped portion 114 defines an outwardly facing pocket 118 which catches one of the tabs 86 on the hair dryer 14 when the concentrator 18 is rotated in one direction relative to the hair dryer 14. In other embodiments (not shown), the lower portion of the L-shaped portion 114 can be eliminated.

As illustrated in FIGS. 2 and 3, each of the projections 106 also includes a lock portion 122 which is connected to the L-shaped portion 114 and spaced apart from the concentrator circular inlet 66 so that the corresponding tab 86 on the hair dryer 14 is held between the lock portion 122 and the concentrator circular inlet 66 when the concentrator 18 is rotated in one direction relative to the hair dryer 14.

As illustrated in FIGS. 2, 3 and 5, the hair drying assembly 10 further includes guide means 130 on the concentrator 18 for assisting in aligning the concentrator circular inlet 66 with the housing circular outlet 42. The guide means 130 is in the form of tabs located equidistant between the projections 106 and extending into the circular outlet 42 of the hair dryer 14 and along the sides 90 thereof to align the concentrator circular inlet 66 with the housing circular outlet 42.

To attach the concentrator 18 to the hair dryer 14, the projections 106 and guide tabs 130 are inserted into the housing circular outlet 42 so as to clear the housing tabs 86 on the sides 90 of the housing circular outlet 42. The concentrator 18 is then rotated in a clockwise direction relative to the hair dryer 14 until the housing tabs 86 contact the projections 106.

To disengage the connecting means 74, the concentrator 18 is rotated in the opposite or counterclockwise direction relative to the hair dryer 14, and then the projections 106 and guide tabs 130 are extracted from the circular outlet 42 of the hair dryer 14.

Figure 7:
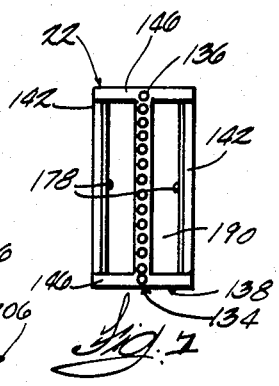
FIG. 7 is a plan view of the comb attachment shown in FIG. 1.

As illustrated in FIGS. 1 and 7, the comb attachment 22 comprises a comb portion 134 including teeth 136 and an attachment portion 138 connected to the comb portion 134. The attachment portion 138 comprises a pair of parallel spaced apart rails 142 which are connected at the ends thereof by bars 146. The comb portion 134 is attached centrally between the rails 142 to the bars 146 connecting the ends of the rails 142.

Figure 8:
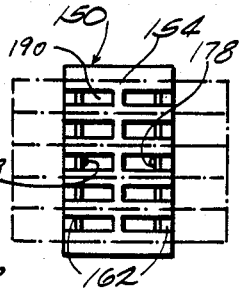
FIG. 8 is a plain view of the brush attachment shown in FIG. 1. Before explaining at least one of the embodiments of the invention in detail, it is to be understood that the invention is not limited in this application to the details of construction and the arrangement of the components as set forth in the following description or illustrated in the drawings. The invention is capable of other embodiments and of being practiced or carried out in various ways. Also, it is to be understood that the phraseology and the terminology employed here are for the purposes of the description and should not be regarded as limiting.

As illustrated in FIGS. 1 and 8, the brush attachment 26 comprises a half circle brush portion 150 including bristles 154 and an attachment portion 162 connected to the brush portion 150. The attachment portion 162 is in the form of a pair of parallel spaced-apart rails 162 connected to the sides of the brush portion 150.

As illustrated in FIGS. 1, 2, 3, 7 and 8, the hair drying assembly 10 also includes means 166 for releasably attaching the brush attachment 26 or comb attachment 22 to the concentrator elongated outlet 70. The releasable attaching means 166 comprises the attachment portion 158 or 138 of the brush or comb attachments 26 and 22 and parallel, spaced-apart, outwardly open indentations 170 on the concentrator 18. The indentations 170 receive the attachment portion rails 142 or 162 as the brush attachment 26 or comb attachment 22 is slipped onto the concentrator elongated outlet 70.

The brush attachment 26 and comb attachment 22 each include openings 190 therein to permit air from the concentrator 18 to pass around the teeth 136 of the comb 22 or the bristles 154 of the brush 26 to dry hair while combing or brushing.

The hair drying assembly 10 also includes detent means 174 for holding the rails 142 and 162 in the outwardly open indentations 170. The detent means 174 comprises a rounded nub 178 centrally located on each of the rails 142 and 146 and a corresponding dent 182 which is on the concentrator 18 in each of the indentations 170 and which releasably receives the respective nub 178.

Various of the feature of the invention are set forth in the following claims.

I claim:

1. A hair drying assembly comprising a hair dryer including a housing defining a straight line air pathway therethrough and including a circular air outlet, and an elongated handle connected to said housing, a hollow concentrator including an elongated outlet and a circular inlet, means for releasably connecting said concentrator to said dryer housing so that said concentrator circular inlet is aligned with said hair dryer circular outlet and so that said concentrator elongated outlet is parallel to said handle, said connecting means comprising projection means on said hair dryer housing and projection engaging means on said concentrator for releasably holding said projection means when said concentrator circular inlet is adjacent said hair dryer circular outlet and said concentrator is rotated in one direction relative to said hair dryer, and for releasing said projection means when said concentrator is rotated in an opposite direction relative to said hair dryer, grooming means including an attachment portion comprising a pair of parallel spaced apart rails, and means for releasably attaching said grooming means to said concentrator elongated outlet comprising parallel spaced apart outwardly open indentations on said concentrator, which indentations receive said attachment portion rails.

2. A hair drying assembly in accordance to claim 1 wherein said grooming means comprises a comb attachment.

3. A hair drying assembly in accordance with claim 1 wherein said grooming means comprises a brush attachment.

4. A hair drying assembly in accordance with claim 1 and further including detent means between one of said rails and one of said identations.

5. A hair drying assembly in accordance with claim 4 wherein said detent means comprises a rounded nub on said one rail and a corresponding opening on said concentrator in said one indentation.

6. A hair drying assembly comprising a hair dryer including a housing defining a straight line air pathway therethrough and including a circular air outlet of a given size, and an elongated handle connected to said housing, a hollow concentrator including an elongated outlet and a circular inlet of a size substantially equal to said given size, and means for releasably connecting said concentrator to said dryer housing so that said concentrator circular inlet is aligned with said hair dryer circular outlet, said connecting means comprising projections means located on one of said hair dryer housing and said concentrator, and projection engaging means on the other of said hair dryer housing and said concentrator for releasably holding said projection means when said concentrator circular inlet is adjacent said hair dryer circular outlet and said concentrator is rotated in one direction relative to said hair dryer, and for releasing said projection means when said concentrator is rotated in an opposite direction relative to said hair dryer.

7. A hair drying assembly comprising a hair dryer including a housing defining a straight line air pathway therethrough and including a circular air outlet of a given size, and an elongated handle connected to said housing, a hollow concentrator including an elongated outlet and a circular inlet of a size substantially equal to said given size, and means for releasably connecting said concentrator to said dryer housing so that said concentrator circular inlet is aligned with said hair dryer circular outlet, said connecting means comprising projection means located on one of said hair dryer housing and said concentrator, and projection engaging means on the other of said hair dryer housing and said concentrator for releasably holding said projection means when said concentrator circular inlet is adjacent said hair dryer circular outlet and said concentrator is rotated in one direction relative to said hair dryer, and for releasing said projection means when said concentrator is rotated in an opposite direction relative to said hair dryer.

8. A hair drying assembly in accordance with claim 7 wherein said projection means comprises tabs projecting inwardly from opposed sides of said housing circular outlet.

9. A hair drying assembly in accordance with claim 8 wherein said projection engaging means comprises opposed projections, each projection including an L-shaped portion which is received in said housing circular outlet and which defines an outwardly facing pocket which catches one of said tabs when said concentrator is rotated in said one direction relative to said hair dryer, and a lock portion which is connected to said L-shaped portion and spaced apart from said concentrator circular inlet so that one of said tabs is held between said lock portion and said concentrator circular inlet when said concentrator is rotated in said one direction relative to said hair dryer.

10. A hair drying assembly in accordance with claim 7 and further including guide means on said concentrator and received in said housing circular outlet for further aligning said concentrator circular inlet with said housing circular outlet.

11. A hair drying assembly in accordance with claim 7 and further including grooming means, and means for releasably attaching said grooming means to said concentrator elongated outlet.

12. A hair drying assembly comprising a hair dryer including a housing defining a straight line air pathway therethrough and including a circular air outlet of a given size, and an elongated handle connected to said housing, a hollow concentrator including an elongated outlet and a circular inlet of a size substantially equal to said given size, means for releasably connecting said concentrator to said dryer housing with said concentrator circular inlet aligned with said hair dryer circular outlet, grooming means including an attachment portion comprising a pair of parallel spaced apart rails, and means for releasably attaching said grooming means to said concentrator elongated outlet comprising parallel spaced apart outwardly open indentations on said concentrator, which indentations receive said attachment portion rails.

13. A hair drying assembly comprising a hair dryer including a housing defining a straight line air pathway therethrough and including a circular air outlet having an end surface, and an elongated handle connected to said housing, a hollow concentrator including an elongated outlet and a circular inlet having an end surface, and means for releasably connecting said concentrator to said dryer housing with said end surfaces in aligned abutting engagement, said connecting means comprising projection means located on one of said hair dryer housing and said concentrator and extending inwardly of the associated one of said housing air outlet and said concentrator inlet, and projection engaging means located on the other of said hair dryer housing and said concentrator and extending toward said one of said housing and said concentrator in inward relation to the other of said housing air outlet and said concentrator inlet for releasably holding said projection means when said concentrator circular inlet is adjacent said hair dryer circular outlet and said concentrator is rotated in one direction relative to said hair dryer, and for releasing said projection means when said concentrator is rotated in an opposite direction relative to said hair dryer.

14. A hair drying assembly comprising a hair dryer including a housing defining a straight line air pathway therethrough and including a circular air outlet having an end surface, and an elongated handle connected to said housing, a hollow concentrator including an elongated outlet and a circular inlet having an end surface, and means for releasably connecting said concentrator to said dryer housing with said end surfaces in aligned abutting engagement, said connecting means comprising projection means located on said hair dryer housing and extending inwardly of said circular air outlet, and projection engaging means located on said concentrator and extending toward said housing in radially inward relation to said air outlet for releasably holding said projection means when said concentrator circular inlet is adjacent said hair dryer circular outlet and said concentrator is rotated in one direction relative to said hair dryer, and for releasing said projection means when said concentrator is rotated in an opposite direction relative to said hair dryer.

15. A hair drying assembly in accordance with claim 14 wherein said inlet includes an end surface, wherein said projection engaging means comprises opposed projections, each projection being L-shaped and including a first leg projecting toward said air outlet in radially inwardly relation thereto, and a second leg extending radially outwardly and defining a pocket between said end surface and said second leg, which pocket receives one of said tabs when said concentrator is rotated in said one direction relative to said hair dryer.

16. A hair drying assembly comprising a hair dryer including a housing defining a straight line air pathway therethrough and including a circular air outlet having an end surface, and an elongated handle connected to said housing, a hollow concentrator including an elongated outlet and a circular inlet having an end surface, and means for releasably connecting said concentrator to said dryer housing with said end surfaces in aligned abutting engagement, said connecting means comprising projection means on one of said hair dryer housing and said concentrator, and projection engaging means on the other of said hair dryer housing and said concentrator for releasably holding said projection means when said end surfaces are in abutting engagement and said concentrator is rotated in one direction relative to said hair dryer, and for releasing said projection means when said concentrator is rotated in an opposite direction relative to said hair dryer.

17. A hair drying assembly comprising a hair dryer including a housing defining a straight line air pathway therethrough and including a circular air outlet having an end surface, and an elongated handle connected to said housing, a hollow concentrator including an elongated outlet and a circular inlet having an end surface, means for releasably connecting said concentrator to said dryer housing with said end surfaces in aligned abutting engagement, grooming means, and means for releasably attaching said grooming means to said concentrator elongated outlet.

* * * * *